US006465945B1

(12) United States Patent
Tsuchida et al.

(10) Patent No.: US 6,465,945 B1
(45) Date of Patent: Oct. 15, 2002

(54) COLOR CATHODE-RAY TUBE

(75) Inventors: Shigeru Tsuchida, Kumagaya; Norio Shimizu, Fukaya; Masatsugu Inoue, Kumagaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 294 days.

(21) Appl. No.: 09/593,394

(22) Filed: Jun. 14, 2000

(30) Foreign Application Priority Data

Jun. 16, 1999 (JP) ..... 11-169216
Jun. 18, 1999 (JP) ..... 11-173206

(51) Int. Cl.[7] ..... H01J 29/10; H01J 29/02; H01J 29/07

(52) U.S. Cl. ..... 313/461; 313/402; 313/466

(58) Field of Search ..... 313/461, 477 R, 313/463, 415, 407, 402, 466, 473; 430/25, 26

(56) References Cited

U.S. PATENT DOCUMENTS 5,216,321 A 6/1993 Kawamura et al.
5,602,442 A * 2/1997 Jeong ..... 313/466
5,682,079 A * 10/1997 Kang ..... 313/461
6,066,914 A 5/2000 Shimizu et al.
2001/0030503 A1 * 10/2001 Kim et al. ..... 313/461

FOREIGN PATENT DOCUMENTS

JP 2001351541 A * 12/2001 ..... H01J/29/32

* cited by examiner

*Primary Examiner*—Ashok Patel
*Assistant Examiner*—Karabi Guharay
(74) *Attorney, Agent, or Firm*—Oblon, Spivak, McClelland, Maier & Neustadt, P.C.

(57) ABSTRACT

The outer surface of a panel effective section of a vacuum envelope is substantially flattened. A phosphor screen is formed on the inner surface of the effective section and includes stripe-shaped phosphor layers and light absorption layers arranged in parallel. The panel effective section is formed such that a corner portion is 8 mm to 15 mm thicker than the central portion and the transmittance of the central portion is set at 40% to 60%. The phosphor screen is formed such that the ratio of the width of a light absorption layer to the pitch of phosphor layers in the central portion of the panel effective section is larger than or equal to that in the peripheral portion thereof. A shadow mask is opposed to the phosphor screen and has a mask body in which a number of electron beam passage apertures are formed. The pitch of apertures formed in the peripheral portion of the mask body is 1.3 to 1.4 times as large as that of apertures formed in the central portion thereof.

5 Claims, 5 Drawing Sheets

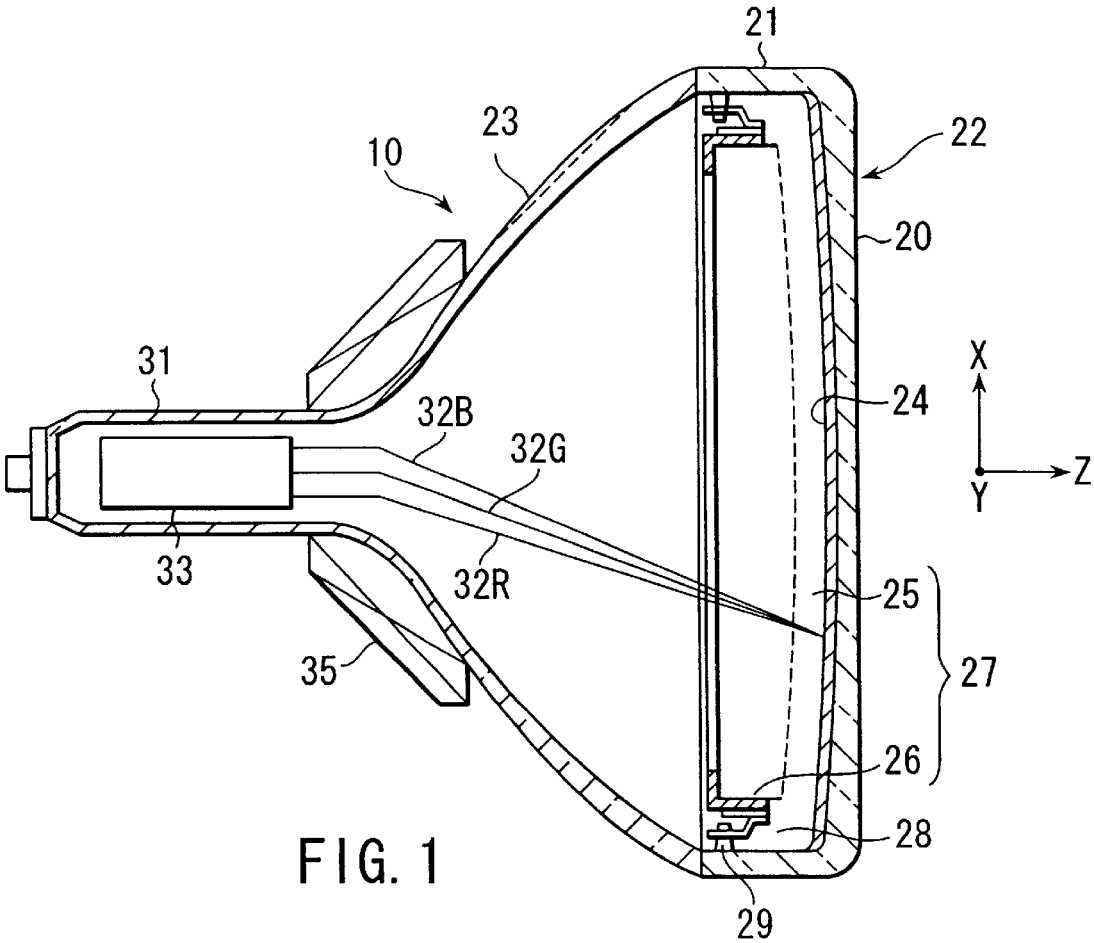
FIG. 1
FIG. 2A
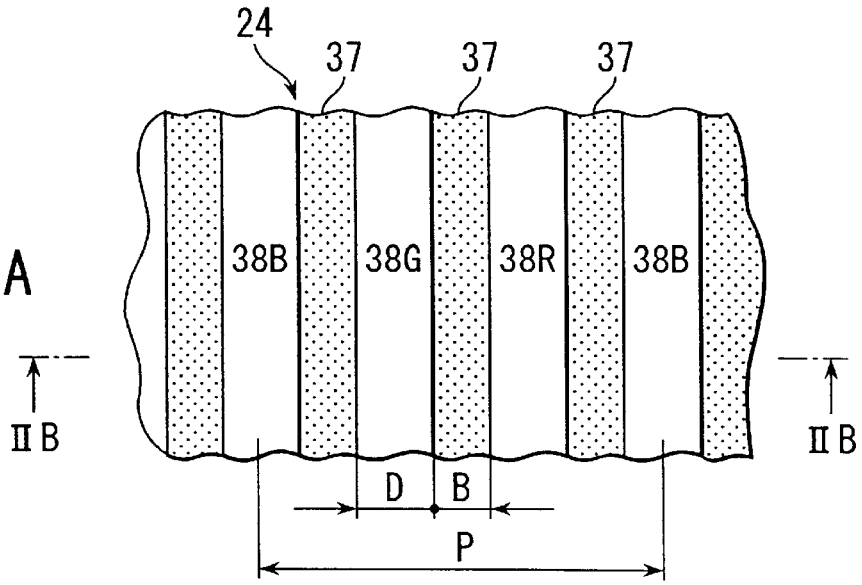
FIG. 2B
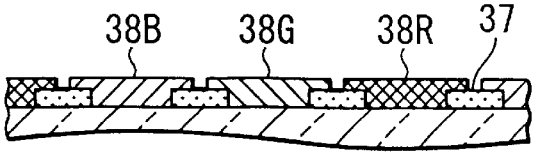

COLOR CATHODE-RAY TUBE

CROSS-REFERENCE TO RELATED APPLICATIONS

This application is based upon and claims the benefit of priority from the prior Japanese Patent Applications No. 11-169216, filed Jun. 16, 1999; and No. 11-173206, filed Jun. 18, 1999, the entire contents of which are incorporated herein by reference.

BACKGROUND OF THE INVENTION

The present invention relates to a color cathode-ray tube whose panel has a flattened effective section.

A commonly-used color cathode-ray tube includes a vacuum envelope having a substantially rectangular panel and a funnel. The panel has an effective section with a curved surface, and a phosphor screen is formed on the inner surface of the effective section. A substantially rectangular shadow mask is opposed to the phosphor screen. The shadow mask has a mask body in which a number of electron beam passage apertures are formed and a mask frame supporting the periphery of the mask body. The shadow mask is supported on the inner surface of the panel by fitting elastic support members, which are attached to the mask frame, to their corresponding stud pins provided on the panel.

An electron gun for emitting electron beams is arranged in a neck of the funnel. In this color cathode-ray tube, three electron beams, which are emitted from the electron gun, are deflected by a deflection yoke mounted on the outer surface of the funnel and scan the phosphor screen horizontally and vertically through the electron beam passage apertures of the shadow mask, thereby displaying a color image.

As the phosphor screen, a black stripe type is known in which a plurality of strip-shaped, black light absorption layers, which are long in the short-axis direction of the panel, are arranged in parallel in the long-axis direction thereof, and strip-shaped three-color phosphor layers, which are long in the short-axis direction of the panel, are each formed between adjacent light absorption layers. In the shadow mask, the plural electron beam passage apertures are arranged in lines to form aperture rows each extending in the short-axis direction of the panel, and a plurality of aperture rows each including a plurality of electron beam passage apertures are arranged in parallel in the long-axis direction.

In the color cathode-ray tube described above, generally, three electron beams need to be correctly landed on their corresponding three-color phosphor layers of the phosphor screen through the apertures of the shadow mask in order to display an image on the phosphor screen without color purity drifts. It is thus necessary to exactly hold the shadow mask in a given position with respect to the panel.

A color cathode-ray tube, which has been improved in viewability by decreasing the curvature of the outer surface of an effective section of a panel nearly to that of the plane, has recently been put to practical use. In this color cathode-ray tube, the curvature of the inner surface of the effective section also needs to decrease in view of formability and viewability of the panel, as does the curvature of a surface opposed to a phosphor screen of a shadow mask in accordance with the curvature of the inner surface of the effective section.

If, however, the curvature of the inner surface of the panel decreases, a reduction in the atmospheric-pressure resistance of the vacuum envelop will turn into problems. If the effective section totally increases in thickness in order to avoid the reduction, the transmittance of the panel decreases and consequently the brightness of an image displayed through the effective section lowers.

If the peripheral portion of the effective section is formed thicker than the central portion thereof in order to secure the atmospheric-pressure resistance, a difference in transmittance between the central and peripheral portions becomes wider in accordance with the increase in the thickness of the peripheral portion. This difference makes a large difference in brightness between the central and peripheral portions of the panel and greatly decreases the viewablity of the panel when an image is displayed. If the transmittance of the panel is increased to avoid these, the contrast of the image is degraded. A method of adhering a film of low transmittance onto the outer surface of the effective section can be adopted as a measure for avoiding the degradation of contrast; however, in this case, the number of manufacturing steps increases and so does the manufacturing costs.

If the shadow mask decreases in curvature in accordance with the inner surface of the effective section of the panel, it decreases in mechanical strength and is easily deformed in the manufacturing process of the color cathode-ray tube. The deformation of the shadow mask degrades color purity.

Furthermore, the color purity is degraded by doming of the shadow mask. In the color cathode-ray tube, as operation principles, electron beams reaching the phosphor screen through the apertures of the shadow mask are not more than one-third of all electron beams emitted from the electron gun, and the other electron beams collide with the portion of the shadow mask other than the apertures and heats the shadow mask. By this heating, the shadow mask is thermally expanded to cause doming expanded in the direction of the phosphor screen.

The doming varies a distance (q value) between the phosphor screen and the shadow mask. If the variation exceeds a permissible range, the electron beams land on positions displaced from target three-color phosphor layers and thus the color purity is degraded. The displacement of the landed beams due to the doming varies with the brightness of an image pattern to be displayed and the duration thereof. When a high-brightness image pattern is locally displayed, a local doming occurs and displaces the landed beams locally in a short time. This doming appears more conspicuously when the shadow mask decreases in curvature and turns into unavoidable problems when the effective section of the panel is flattened.

BRIEF SUMMARY OF THE INVENTION

The present invention has been developed in consideration of the above problems and its object is to provide a color cathode-ray tube which is improved in image quality by reducing a deterioration in color purity and a difference in brightness, without degrading the atmospheric-pressure resistance of a panel or the mechanical strength of a shadow mask, even when the outer surface of an effective section of the panel is flattened.

To attain the above object, a color cathode-ray tube according to one aspect of the present invention comprises:

- an envelope including a panel having a substantially rectangular effective section with a substantially flat outer surface, and a funnel joined to the panel;
- a phosphor screen formed on an inner surface of the panel, the phosphor screen including a plurality of strip-shaped light absorption layers arranged in parallel with one another and a plurality of strip-shaped phosphor layers arranged in parallel and each formed in a gap between adjacent light absorption layers;

an electron gun arranged in a neck of the funnel, for emitting electron beams toward the phosphor screen; and a shadow mask provided opposite to the phosphor screen, the shadow mask having a plurality of aperture rows arranged in parallel, each of the aperture rows including a plurality of apertures arranged in line, a bridge being interposed between adjacent apertures, wherein the envelope includes a tube axis extending through a center of the effective section and the electron gun, a long axis crossing the tube axis at right angles, and a short axis crossing the long axis and the tube axis at right angles;

the effective section of the panel is formed such that a corner portion is 8 mm to 15 mm thicker than a central portion, and transmittance of the central portion is set to 40% to 60%; and the phosphor screen is formed such that a ratio of a width of each of the light absorption layers to the pitch of the phosphor layers is larger in the central portion of the effective section than in at least a part of a peripheral portion thereof.

In the color cathode-ray tube having the above structure, even though the outer surface of the effective section of the panel is almost flattened, an adequate atmospheric-pressure resistance can be maintained in the vacuum envelope and the peripheral portion of the panel can be prevented from decreasing in brightness.

According to the color cathode-ray tube of the present invention, the phosphor layers and the light absorption layers of the phosphor screen, and the aperture rows of the shadow mask extend substantially in parallel with the short axis, and if a width of apertures formed in a central portion of the shadow mask along the long axis is Ac, a width of apertures formed in short axis end portions thereof along the long axis is Av, a width of apertures formed in long axis end portions thereof along the long axis is Ah, and a width of apertures formed at each corner portion thereof along the long axis is Ad, following relationships are given:

$$Ac \leqq Av < Ad, \text{ and } Ac < Ah \leqq Ad.$$

Moreover, according to the color cathode-ray tube of the present invention, the aperture rows of the shadow mask extend substantially in parallel with the short axis, and if a pitch of apertures arranged in a central portion of the shadow mask along the long axis is Wc, a pitch of apertures arranged in a short axis end portions thereof along the long axis is Wv, a pitch of apertures arranged in a long axis end portions thereof along the long axis is Wh, and a pitch of apertures arranged at a corner portion thereof along the long axis is Wd, following relationships are given:

$$Wc \leqq Wv, \text{ and } 1.3Wc < Wh < Wd.$$

In the color cathode-ray tube having the above structure, the pitch of rows of electron beam passage apertures in the peripheral portion of the panel is 1.3 times or larger than that in the central portion thereof. It is thus possible to obtain an adequate margin for multicolor emission of electron beams caused by variations in electron-beam landing position due to thermal expansion of the shadow mask can be obtained, thereby suppressing a degradation in color purity due to the variations in electron-beam landing position.

In the color cathode-ray tube of the present invention, if thicknesses of a central portion, long axis end portions, short axis end portions, and corner portions of the effective section of the panel are tc, tv, th, and td, respectively, it is desirable to satisfy the following relationships in order to improve in strength:

$$tc < tv < td, \text{ and } tc < th < td.$$

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 is a cross-sectional view showing a color cathode-ray tube according to an embodiment of the present invention;

FIG. 2A is an enlarged plan view showing a part of a phosphor screen of the color cathode ray tube;

FIG. 2B is a cross-sectional view taken along line IIB—IIB of FIG. 2A;

DETAILED DESCRIPTION OF THE INVENTION

Figure 3:
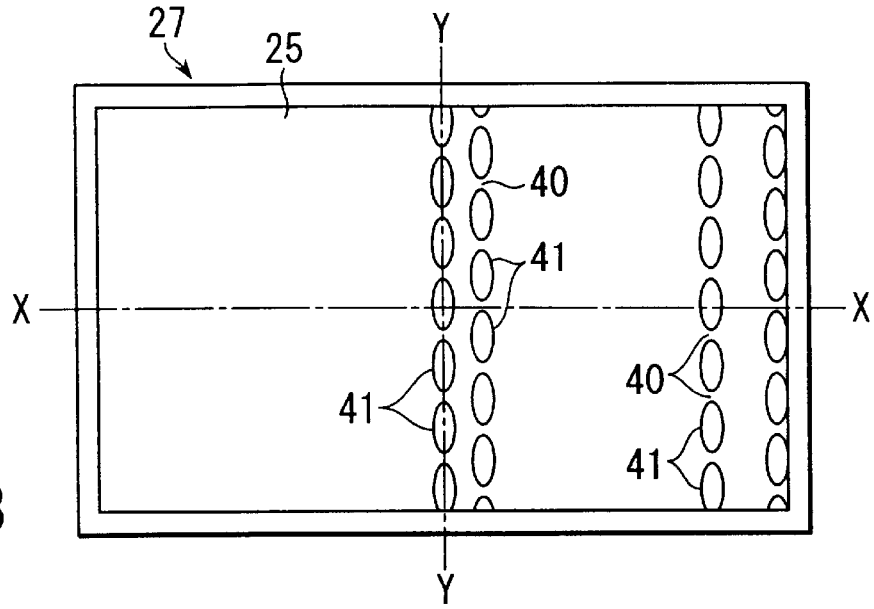
FIG. 3 is a plan view showing a shadow mask of the color cathode-ray tube.

A color cathode-ray tube according to an embodiment of the present invention will now be described in detail with reference to the accompanying drawings.

As illustrated in FIG. 1, the color cathode-ray tube comprises a vacuum envelope 10 which includes a glass-made panel 22 having a substantially rectangular effective section 20 and a skirt section 21 standing along the peripheral portion of the effective section, and a glass-made funnel 23 joined to the skirt section 21.

A phosphor screen 24 is formed on the inner surface of the effective section 20 of the panel 22. A shadow mask 27 is arranged in the vacuum envelope 10 and opposed to the phosphor screen 24. The shadow mask 27 is constituted of a substantially rectangular mask body 25 having a number of electron beam passage apertures and a rectangular mask frame 26 supporting a peripheral portion of the mask body. The shadow mask 27 is detachably supported on the panel 22 by fitting elastic support members 28 mounted on the mask frame 26 to stud pins 29 provided on the inner surface of the skirt section 21. The funnel 23 includes a neck 31 in which an electron gun 33 for emitting three electron beams 32B, 32G and 32R is arranged.

The vacuum envelope 10 including the panel 22 has a tube axis Z extending through the center of the effective section 20 and the electron gun 33, a long axis (horizontal axis) X crossing the tube axis at right angles, and a short axis (vertical axis) Y crossing the tube axis Z and long axis X at right angles.

The three electron beams 32B, 32G and 32R emitted from the electron gun 33 are deflected by a deflection yoke 35 mounted on the outer surface of the funnel 23, and the phosphor screen 24 is scanned horizontally and vertically with the electron beams through the electron beam passage apertures of the shadow mask 27, thus displaying a color image.

In this embodiment, the outer surface of the effective section 20 of the panel 22 is an almost flat one or a curved one having a gentle curvature, while the inner surface thereof has a curved one having a larger curvature than that of the outer surface. The effective section 20 is 8 to 15 mm thicker in its corner portions than in its central portion. The transmittance of the central portion of the effective section 20 ranges from 40% to 60%.

As shown in FIG. 2, the phosphor screen 24 includes a plurality of strip-shaped black light absorption layers 37 extending in a direction parallel to the short axis Y of the panel 22 and arranged in parallel at regular intervals in the direction of the long axis X, and strip shaped three-color phosphor layers 38B, 38G and 38R extending in a direction parallel to the short axis Y and each formed between adjacent light absorption layers 37. The ratio M (=P/B) of width B of each of the light absorption layer 37 to pitch P of the phosphor layers, which are viewed from the outer surface of the effective section 20 of the panel 22, in the central portion of the panel is larger than or equal to those in the peripheral portions thereof in the long- and short-axis directions. The pitch of the three-color phosphor layers 38B, 38G and 38R along the long axis X is indicated by P.

The mask body 25 of the shadow mask 27 has a curved surface whose curvature corresponds to that of the inner surface of the effective section 20 of the panel 22. As shown in FIG. 3, a plurality of aperture rows extending almost in parallel with the short axis Y are arranged on the mask body 25 at regular intervals in the direction of the long axis X. Each of the aperture rows includes a plurality of electron beam passage apertures 41 arranged in line. A bridge 40 is interposed between two adjacent electron beam passage apertures 41.

Assume that the apertures 41 arranged in the central portion of the mask body 25 have a pitch Wc in the direction of the long axis X, the apertures 41 arranged in the short axis end portions, i.e., in portions close to the long sides of the mask body have a pitch Wv in the direction thereof, the apertures 41 arranged in the long axis end portions, i.e., in portions close to the short sides of the mask body have a pitch Wh in the direction thereof, and the apertures 41 arranged at the corner portions have a pitch Wd in the direction thereof. The apertures 41 are therefore formed so as to satisfy the following expressions (1) and (2):

$$Wc \leqq Wv \quad (1)$$

$$1.3Wc < Wh \leqq Wd \quad (2)$$

Assume that the apertures 41 arranged in the central portion of the mask body 25 each have a width Ac in the direction of the long axis X crossing the aperture rows at right angles, the apertures 41 arranged in the short axis end portions of the mask body each have a width Av in the direction thereof, the apertures 41 arranged in the long axis end portions of the mask body each have a width Ah in the direction thereof, and the apertures 41 arranged at the corner portions of the mask body each have a width Ad in the direction thereof. The apertures 41 is therefore formed so as to satisfy the following expressions (3) and (4):

$$Ac \leqq Av < Ad \quad (3)$$

$$Ac < Ah \leqq Ad \quad (4)$$

In the color cathode-ray tube, the phosphor screen 24 can easily be produced by photolithography using the shadow mask 27 as a photomask.

According to the color cathode-ray tube described above, the atmospheric-pressure resistance necessary for the vacuum envelope 10 can be secured even though the effective section 20 of the panel 22 is flattened, and the brightness of an image seen through the effective section 20, especially that of the peripheral portion of the screen can be improved. Moreover, even though the effective section 20 is flattened, the mechanical strength of the shadow mask 27 can be prevented from decreasing, and the shadow mask 27 can be inhibited from being deformed in the manufacturing process of the color cathode-ray tube and from being domed when the tube operates, thereby lessening a degradation of color impurity.

Specific examples 1 and 2 corresponding to the embodiment of the present invention will now be described together with a comparison example.

Assume that the comparison example is directed to a color cathode-ray tube whose panel has an aspect ratio of 4:3 and a diagonal line of 60 cm. In this color cathode-ray tube, the glass transmittance in the central portion of the effective section of the panel is about 80%, the thickness of the central portion is 12.5 mm, and a difference in thickness (wedge) between the central and peripheral portions of the effective section is set at 13 mm, the latter being thicker than the former. The ratio of the width of a light absorption layer to the pitch of phosphor layers of a phosphor screen is about 37% in the central portion of the effective section and about 51% in the peripheral portion thereof. The width of a bridge formed between adjacent apertures constituting an aperture row of a shadow mask is about 100 μm in the central portion of the mask body and about 120 μm in the peripheral portion thereof. The apertures of the shadow mask are arranged at variable pitches such that the pitch of apertures in the central portion of the shadow mask along the long axis is 140% of that of apertures arranged in the long axis end portions thereof. The ratio CB (corner brightness) of brightness of corner portions of the effective section to that of the central portion thereof is about 62%.

The brightness ratio CB corresponds to transmittance Tr of the effective section of the panel, which is given by the following equation (5), when the transmittance of the central portion of the effective section is Tc and that of the peripheral portion thereof is Td.

$$Tr=Td/Tc \quad (5)$$

In the embodiment of the present invention, that value which is measured by directing light with a wave length of 546 nm in a direction parallel to the tube axis Z is used as the glass transmittance of the panel.

In a color cathode-ray tube of specific example 1, the outer surface of a panel effective section is flattened, and the thickness of a central portion of the panel effective section, the width of a bridge between adjacent apertures constituting an aperture row of a shadow mask, and the pitch of apertures along the long axis of the shadow mask are set to the same as those of the comparative example described above. The glass transmittance of the central portion of the panel effective section is decreased to about 55%, and the ratio M of width B of the light absorption layer 37 to pitch P of the phosphor layers (M=B/P) is about 47% in the central portion of the effective section and about 43% in the peripheral portion thereof. As a result, the brightness ratio CB of corner portions to that of the central portion of the effective section is about 60%, and the same satisfactory values as those of the comparative example are maintained.

In a color cathode-ray tube of specific example 2, the thickness of a central portion of a panel effective section, the width of a bridge between adjacent apertures constituting an aperture row of a shadow mask, and the pitch of apertures along the long axis of the shadow mask are set to the same as those of the comparative example described above. However, the glass transmittance of the central portion of the panel effective section is decreased to about 40%, and the ratio M of width B of a light absorption layer 37 to pitch P of phosphor layers (M=B/P) is about 53% in the central portion of the effective section and about 35% in the peripheral portion thereof. Consequently, the ratio CB of the brightness of corner portions of the effective section to that of the central portion thereof is about 60%, and the same satisfactory values as those of the comparative example are maintained.

Table 1 shows the comparative example and the specific examples 1 and 2 as follows:

TABLE 1

| | Comparative Example | Example 1 | Example 2 |
|---|---|---|---|
| Transmittance (%) of Central Portion of Panel Effective Section | 80 | 55 | 40 |
| Thickness (mm) of Central Portion of Panel Effective Section | 12.5 | 12.5 | 12.5 |

TABLE 1-continued

| | Comparative Example | Example 1 | Example 2 |
|---|---|---|---|
| Difference (mm) in Thickness Between Central and Peripheral Portions of Panel Effective Section | 13 | 13 | 13 |
| Ratio (%) of Area of Light Absorption Layers to Area of Phosphor layers in Central Portion of Panel Effective Section | 37 | 51 | 59 |
| Ratio (%) of Area of Light Absorption Layers to Area of Phosphor layers in Central Portion of Panel Effective Section | 55 | 43 | 35 |
| Width (μm) of Bridge in Central Portion of Mask Body | 100 | 100 | 100 |
| Width (μm) of Bridge in Peripheral Portion of Mask Body | 110 | 110 | 110 |
| Ratio (%) of Through-Hole Pitch of Peripheral Portion of Mask Body to that of Central Portion thereof | 140 | 140 | 140 |
| CB (%) | About 60 | About 60 | About 60 |

As is seen from the above table, in the specific examples 1 and 2, and in an example 3 describe later, the glass transmittance of the panel effective section is about 25% to 40% lower than that in the comparative example, and the ratio M of the width of the light absorption layer in the central portion of the effective section to the pitch of the phosphor layers is set larger than that in the comparative example, thus improving in contrast. The same characteristics as those in using a color selection filter can be obtained without providing any color selection filter on the outer surface of the panel.

If the transmittance of the panel effective section is set lower than 40%, the corner brightness (CB) falls short of 60% when the color cathode-ray tube operates and accordingly the tube degrades in viewability. It is therefore undesirable to make the transmittance of the central portion of the panel effective section lower than 40% but desirable to set it within a range from 40% to 60% in view of viewability in order to secure the corner brightness of 60% or higher during the operation of the cathode-ray tube.

The relationship between a difference in thickness between the central and peripheral portions of the effective section of the panel (panel wedge) and atmospheric-pressure resistance (or explosion-proof characteristic) will now be described. According to the embodiment of the present invention, if the thicknesses of the central portion, the short axis end portions, the long axis end portions, and the corner portions of the effective section are tc, tv, th and td, the panel is formed to satisfy the following expressions and improve the atmospheric-pressure resistance.

$$tc<tv<td,\ tc<th<td$$

When the curvature radius of the outer surface of the panel effective section is 10 m, the relationship between the thickness difference between the central and peripheral portions of the effective section (panel wedge) and the atmospheric-pressure resistance is shown in table 2 indicated below.

As is seen from the table, if the thickness difference is smaller than 8 mm, the vacuum envelope is insufficient in atmospheric-pressure resistance as indicated by X (cross). To secure atmospheric-pressure resistance necessary for the vacuum envelope, the difference has to be set to 8 mm or larger as indicated by Δ or ○. The difference can be 20 mm in consideration of only the atmospheric-pressure resistance; however, in this case, the corner brightness ratio CB of brightness of the corner portions of the effective section to that of the central portion thereof is decreased and the cathode-ray tube is of no practical use in view of viewability. If the glass transmittance of the panel effective section is set to 40% to 60% in view of viewability, then a range between 8 mm and 15 mm is adequate as the thickness difference.

TABLE 2

| Difference (mm) in Thickness between Central and Peripheral Portions of Panel Effective Section | 0 | 5 | 8 | 10 | 15 | 20 |
|---|---|---|---|---|---|---|
| Atmospheric-Pressure Resistance | X | X | X-Δ | ○ | ○ | ○ |

The relationship between the phosphor layers 38B, 38G and 38R and the black light absorption layers 37 of the phosphor screen 24 formed on the inner surface of the effective section 20 of the panel 22, will now be described in detail.

Figure 4A:
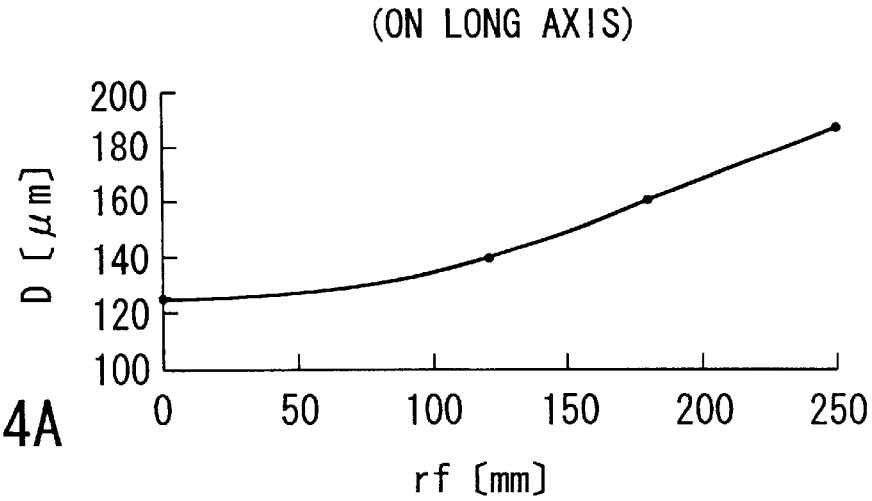
FIG. 4A is a graph showing a relationship between the widths of phosphor layers of the phosphor screen and the positions on the long axis of an effective section of a panel.
Figure 4B:
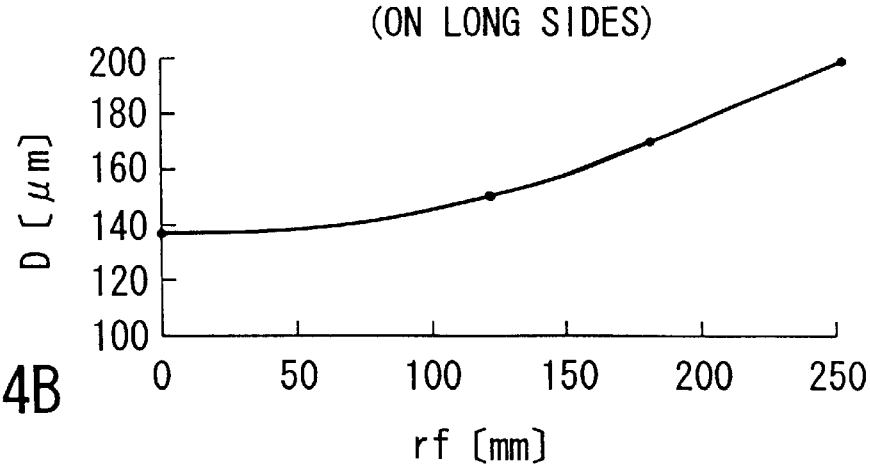
FIG. 4B is a graph showing a relationship between the widths of phosphor layers of the phosphor screen and the positions on the long sides of the effective section.

In the graphs shown in FIGS. 4A and 4B, the y-axis represents widths D of the phosphor layers and the x-axis does the distances rf from the central portion of the effective section 20 in the direction of the long axis X. FIG. 4A shows widths D in respective positions along the long axis X, while FIG. 4B does widths D in respective positions on the long sides of the effective section 20. It is clear from these figures that the width D of the phosphor layers increases toward the peripheral portion of the effective section 20 from the central portion thereof.

Figure 5A:
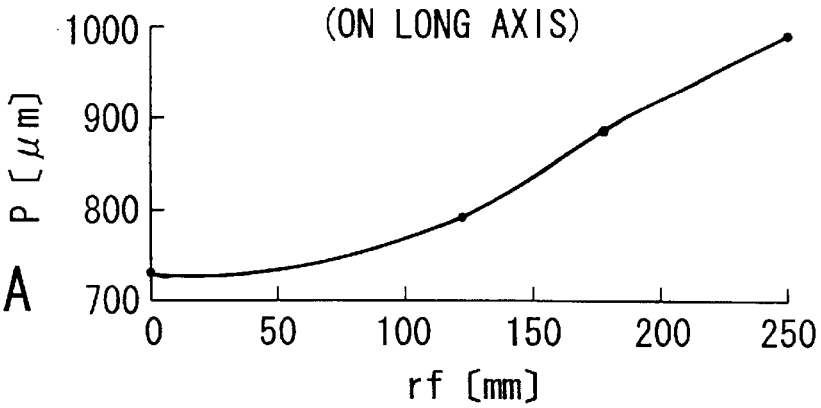
FIG. 5A is a graph showing a relationship between the pitches of the phosphor layers and the positions on the long axis of the effective section.
Figure 5B:
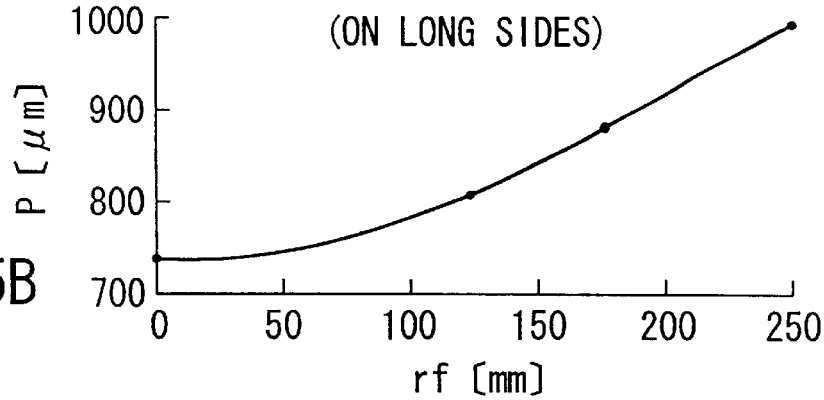
FIG. 5B is a graph showing a relationship between the pitches of the phosphor layer and the positions on the long sides of the effective section.

In the graphs shown in FIGS. 5A and 5B, the y-axis indicates the pitch P of the phosphor layers and the x-axis does the distance rf from the central portion of the effective section 20 in the direction of the long axis X. FIG. 5A shows pitches P in respective positions along the long axis X, while FIG. 5B does pitches P in respective positions on the long sides of the effective section 20. It is clear from these figures that the pitch P of the phosphor layers also increases toward the peripheral portion of the effective section 20 to the central portion thereof.

Figure 6A:
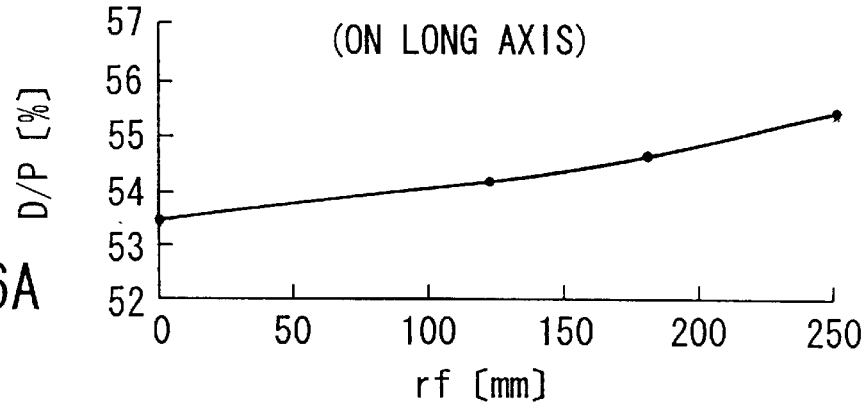
FIG. 6A is a graph showing a relationship between the ratio D/P of pitches of the phosphor layers to widths thereof and the positions on the long axis of the effective section.
Figure 6B:
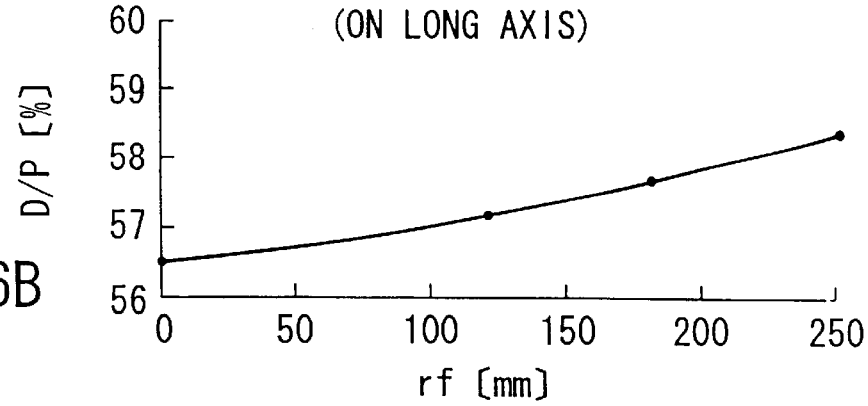
FIG. 6B is a graph showing a relationship between the ratio D/P of pitches of the phosphor layers to widths thereof and the positions on the long sides of the effective section.

If the widths of the phosphor layers in the central portion, the long-side portions, the short-side portions, and the corner portions of the panel effective section are Dc, Dv, Dh, and Dd, respectively and the pitches of the phosphor layers in these portions are Pc, Pv, Ph, and Pd, the ratio of width D to pitch P has the following relationships as shown in FIGS. 6A and 6B:

$$(Dc/Pc) \leqq (Dv/Pv) < (Dd/Pd), \text{ and } (Dc/Pc) < (Dh/Ph) \leqq (Dd/Pd).$$

The relationships indicate, as described above, that the ratio M of width B of the light absorption layer to pitch P of the phosphor layers in the central portion of the effective section is set larger than or equal to that in the peripheral portion.

Figure 7A:
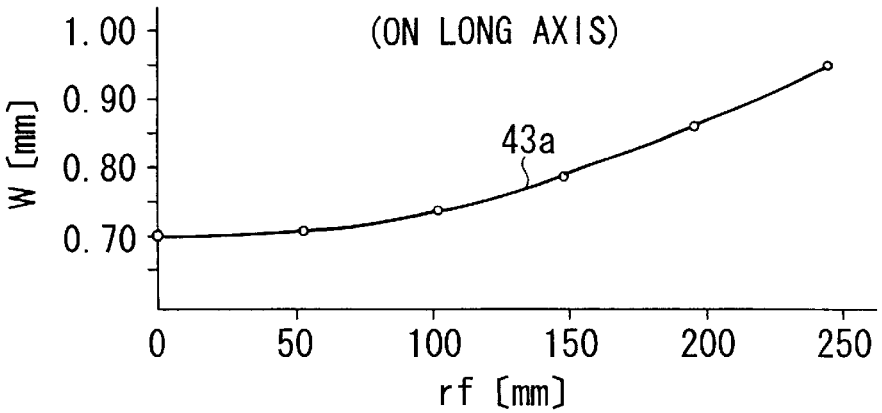
FIG. 7A is a graph showing a relationship between the pitches of the apertures formed in the shadow mask and the positions on the long axis of the mask body.
Figure 7B:
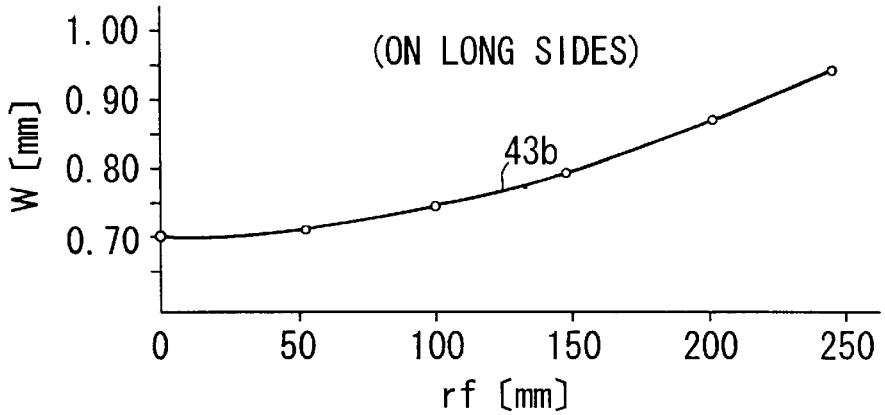
FIG. 7B is a graph showing a relationship between the pitches of the apertures formed in the shadow mask and the positions on the long sides of the mask body.
Figure 8A:
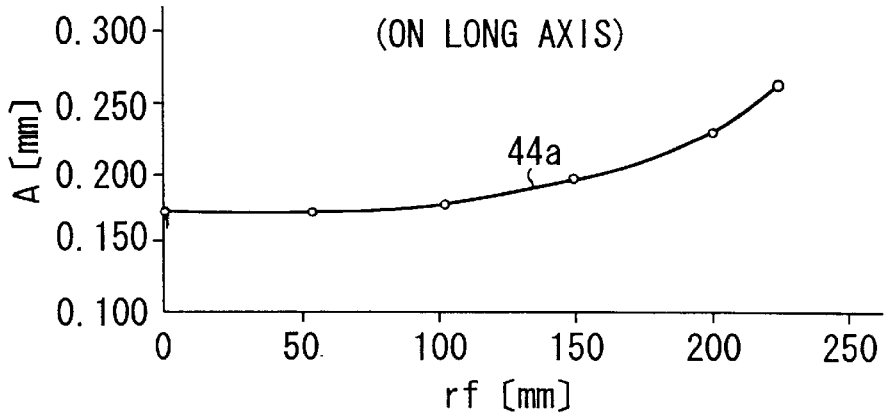
FIG. 8A is a graph showing a relationship between the widths of apertures formed in the shadow mask and the positions on the long axis of a mask body.
Figure 8B:
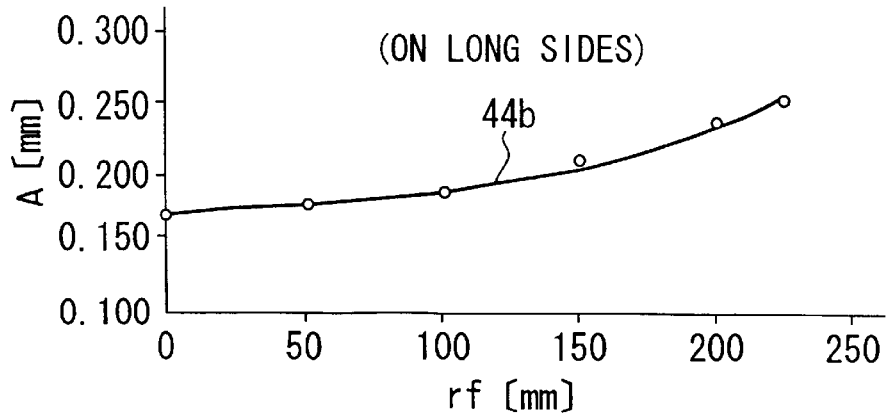
FIG. 8B is a graph showing a relationship between the widths of apertures formed in the shadow mask and the positions on the long sides of the mask body.

In the shadow mask 27 used when the ratio M is set larger than or equal to in the central portion than in the peripheral portion, the aperture widths A in the direction of the long axis and the aperture pitches W in the direction of the long axis are set as shown in FIGS. 7A to 8B. In FIG. 7A, a curve 43*a* indicates the aperture widths A in respective positions along the long axis of the mask body 25. In FIG. 7B, a curve 43*b* indicates the aperture widths A in respective positions on the long sides of the mask body. In FIG. 8A, a curve 44*a* shows aperture pitches W in respective positions along the long axis X of the mask body. In FIG. 8B, a curve 44*b* shows aperture pitches W in respective positions on the long sides of the mask body.

The aperture widths A and aperture pitches W in the respective positions of the mask body 25 are as follows, which satisfy the foregoing expressions (1) to (4).

$$Wc=0.700 \text{ mm}, Wv=0.705 \text{ mm}, Wh=0.920 \text{ mm}, Wd=0.925 \text{ mm}$$

$$Wc \leqq Wv, 1.3Wc < Wh \leqq Wd$$

$$Ac=0.170 \text{ mm}, Av=0.170 \text{ mm}, Ah=0.251 \text{ mm}, Ad=0.253 \text{ mm}$$

$$Ac \leqq Av < Ad, Ac < Ah \leqq Ad$$

The following table 3 is directed to a variable-pitch shadow mask in which the aperture pitch W in the direction of the long axis X is set larger in the peripheral portion of the mask body 25 than in the central portion thereof. Table 3 shows determination results of a relationship between the ratio of aperture pitch Wc in the central portion of the mask body 25 to aperture pitch Wh in the long axis end portions thereof (Wc/Wh) and the landing margin of electron beams to the phosphor layers when the shadow mask is thermally expanded.

TABLE 3

| Wh/Wc | 1.2 | 1.3 | 1.4 |
|---|---|---|---|
| Landing Margin in Short-Side Portions (μm) | 34.0 | 59.0 | 83.0 |
| Results of Determination | X | Δ-○ | ○ |

Even though the shadow mask is thermally expanded, a landing margin of at least 50 -μm is desired in order to prevent electron beams from being erroneously landed at another-color phosphor layers. In the variable-pitch shadow mask, therefore, an adequate margin for multicolor emission of electron beams can be obtained if the ratio Wc/Wh is set at about 1.3 to 1.4 as shown in Table 3.

In a phosphor screen formed using such a shadow mask, even when the ratio of the width of a light absorption layer to the pitch of phosphor layers in the central portion of a panel effective section is set larger than or equal to that in the peripheral portion thereof in order to prevent a degradation in viewability due to a difference in brightness between the central and peripheral portions, the width of the light absorption layer can sufficiently be increased in the peripheral portion. For this reason, even though the shadow mask is thermally expanded by the collision of electron beams, the multicolor emission of electron beams in the peripheral portion of the panel or the landing of electron beams at a plurality of phosphor layers can be lessened and accordingly an adequate margin for a degradation in color purity can be obtained. In other words, it is desirable that a margin for an error in landing of electron beams caused by variations in electron beams due to thermal expansion of a shadow mask be at least 50 μm and, as described above, the margin has an adequate value of 59 μm if the ratio Wc/Wh is set at about 1.3.

As shown in FIGS. 4A to 5B, the width D and pitch P of the phosphor layers are both set larger in the peripheral portion of the panel than in the central portion thereof. This is because a margin for multicolor emission of electron beams is lowered due to variations in electron beam if only the width D is increased and the pitch P is decreased. It is thus important that the width D and pitch P of the phosphor layers be set larger in the peripheral portion of the panel than in the central portion thereof.

In the shadow mask described above, a distance (q value) between the inner surface of the panel effective section and the mask body can be increased and so can be the curvature of the mask body. Consequently, the mechanical strength of the shadow mask can be enhanced, and the shadow mask can be inhibited from being deformed in the manufacturing process of the color cathode-ray tube or from being domed locally when the cathode-ray tube operates, thereby lessening a degradation of color purity.

Figure 9A:
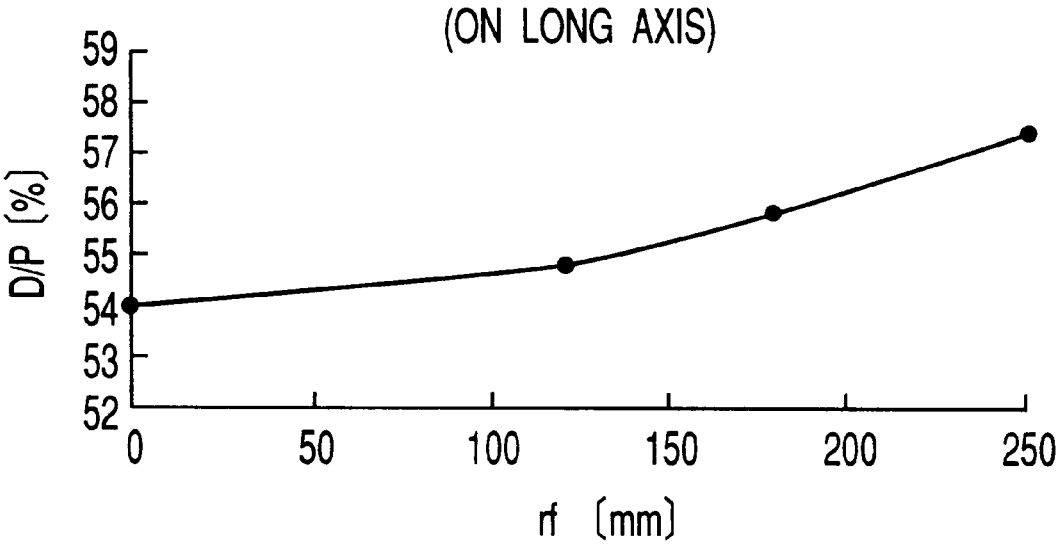
FIG. 9A is a graph showing a relationship between the ratio D/P of pitches of the phosphor layers to widths thereof and the positions on the long axis of the effective section in an example 3.
Figure 9B:
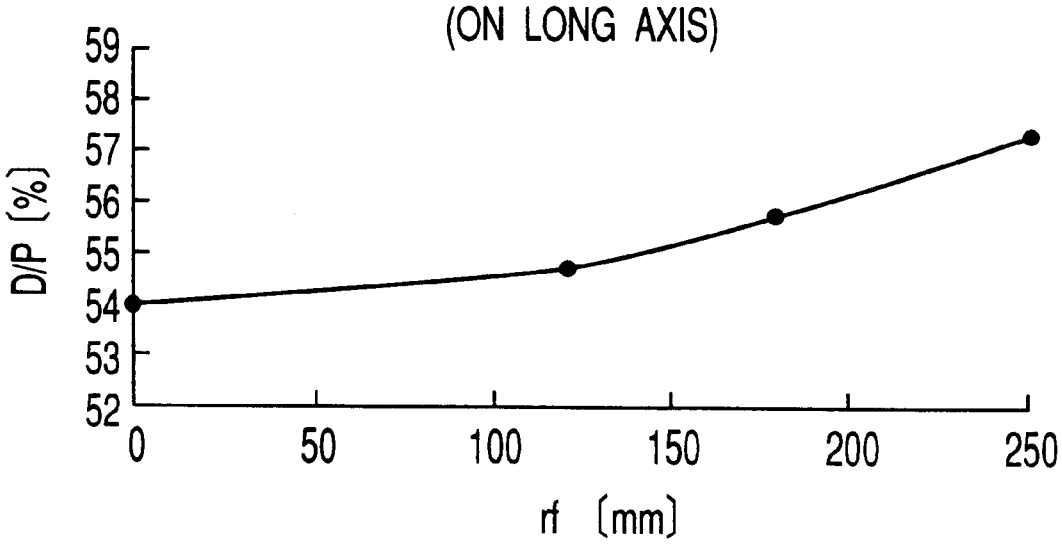
FIG. 9B is a graph showing a relationship between the ratio D/P of pitches of the phosphor layers to widths thereof and the positions on the long sides of the effective section in the example 3.

As in an example 3 shown in FIGS. 9A and 9B, if the ratios M of the width of a light absorption layer to the pitch of phosphor layers in the central portion, the short axis end portions, the long axis end portions, and the corner portions of the effective section are referred as Mc, Mv, Mh and Md, respectively, these ratios may be set to satisfy the following relationship:

$$Mc \approx Mv,\ Mh \approx Md$$

In this case, the same effects as in examples 1 and 2 can be obtained.

The present invention is not limited to the above-mentioned embodiment. Various changes and modifications can be made within the scope of the present invention. For example, in the above embodiment, the radius of curvature of the outer surface of the effective section of the panel is 10 m; however, a more remarkable effect can be produced if the curvature radius is larger than 10 m.

In the color cathode-ray tube as described in detail above, even though the outer surface of the effective panel is almost plane, the atmospheric-pressure resistance necessary for the vacuum envelope can be secured and so can be satisfactorily the brightness of images seen through the effective section, especially that of the peripheral portion of the screen. Even though the curvature of the shadow mask decreases as the effective section of the panel is flattened, the mechanical strength of the shadow mask can be prevented from decreasing, and the shadow mask can be inhibited from being deformed in the manufacturing process of the color cathode-ray tube or from being domed when the tube operates, thereby lessening a degradation in color purity.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode-ray tube comprising:

an envelope including a panel having a substantially rectangular effective section with a substantially flat outer surface, and a funnel joined to the panel;

a phosphor screen formed on an inner surface of the panel, the phosphor screen including a plurality of strip-shaped light absorption layers arranged in parallel with one another and a plurality of strip-shaped phosphor layers arranged in parallel and each formed in a gap between adjacent light absorption layers;

an electron gun arranged in a neck of the funnel, for emitting electron beams toward the phosphor screen; and a shadow mask provided opposite to the phosphor screen, the shadow mask having a plurality of aperture rows arranged in parallel, each of the aperture rows including a plurality of apertures arranged in line, a bridge being interposed between adjacent apertures, wherein the envelope includes a tube axis extending through a center of the effective section and the electron gun, a long axis crossing the tube axis at right angles, and a short axis crossing the long axis and the tube axis at right angles;

the effective section of the panel is formed such that a corner portion is 8 mm to 15 mm thicker than a central portion, and glass transmittance in the central portion is set to 40% to 60%; and the phosphor screen is formed such that a ratio of a width of each of the light absorption layers to a pitch of the phosphor layers is larger in the central portion of the effective section than in at least a part of a peripheral portion thereof.

2. A color cathode-ray tube according to claim 1, wherein the phosphor layers and the light absorption layers of the phosphor screen, and the aperture rows of the shadow mask extend substantially in parallel with the short axis, and if a width of apertures formed in a central portion of the shadow mask along the long axis is Ac, a width of apertures formed in short axis end portions thereof along the long axis is Av, a width of apertures formed in long axis end portions thereof along the long axis is Ah, and a width of apertures formed at corner portions thereof along the long axis is Ad, following relationships are given:

$$Ac \leqq Av < Ad,\ \text{and}\ Ac < Ah \leqq Ad.$$

3. A color cathode-ray tube according to claim 1, wherein the aperture rows of the shadow mask extend substantially in parallel with the short axis, and if a pitch of apertures arranged in a central portion of the shadow mask along the long axis is Wc, a pitch of apertures arranged in short axis end portions thereof along the long axis is Wv, a pitch of apertures arranged in long axis end portions thereof along the long axis is Wh, and a pitch of apertures arranged at corner portions thereof along the long axis is Wd, following relationships are given:

$$Wc \leqq Wv,\ \text{and}\ 1.3Wc < Wh \leqq Wd.$$

4. A color cathode-ray tube according to claim 1, wherein if widths of the phosphor layers in a central portion, short axis end portions, long axis end portions, and corner portions of the effective section of the panel are Dc, Dv, Dh, and Dd, respectively and pitches of the phosphor layers in the central portion, the short axis end portions, the long axis end portions, and the corner portions are Pc, Pv, Ph, and Pd, respectively, ratios of the widths to the pitches are set so as to have following relationships:

$$(Dc/Pc) \leqq (Dv/Pv) < (Dd/Pd),\ \text{and}\ (Dc/Pc) < (Dh/Ph) \leqq (Dd/Pd).$$

5. A color cathode-ray tube according to claim 1, wherein if thicknesses of a central portion, short axis end portions, long axis end portions, and corner portions of the effective section of the panel are tc, tv, th, and td, respectively, following relationships are given:

$$tc < tv < td,\ \text{and}\ tc < th < td.$$

* * * * *

UNITED STATES PATENT AND TRADEMARK OFFICE

CERTIFICATE OF CORRECTION

PATENT NO. : 6,465,945 B1
DATED : October 15, 2002
INVENTOR(S) : Tsuchida et al.

It is certified that error appears in the above-identified patent and that said Letters Patent is hereby corrected as shown below:

Title page, Item [54] and Column 1, line 1,
Should read:
-- [54] COLOR CATHODE RAY TUBE HAVING SPECIFIC RATIO OF WIDTH OF LIGHT ABSORPTION LAYER TO PITCH OF THE PHOSPHOR LAYERS --

Signed and Sealed this

Fourth Day of February, 2003

JAMES E. ROGAN
*Director of the United States Patent and Trademark Office*